US012215556B2

(12) United States Patent
Flores et al.

(10) Patent No.: US 12,215,556 B2
(45) Date of Patent: Feb. 4, 2025

(54) ANISOTROPIC MECHANICAL SHEAR BOLT

(71) Applicant: Baker Hughes Oilfield Operations LLC, Houston, TX (US)

(72) Inventors: Juan Carlos Flores, The Woodlands, TX (US); Hernando Andres Garcia Silva, Pinehurst, TX (US); Andrew Ponder, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/302,192

(22) Filed: Apr. 18, 2023

(65) Prior Publication Data

US 2024/0352813 A1 Oct. 24, 2024

(51) Int. Cl.
*E21B 23/00* (2006.01)

(52) U.S. Cl.
CPC ..... *E21B 23/00* (2013.01)

(58) Field of Classification Search
CPC ..... E21B 23/00; E21B 17/06
USPC ..... 403/2
See application file for complete search history.

(56) References Cited

U.S. PATENT DOCUMENTS

| | | | | |
|---|---|---|---|---|
| 8,469,096 | B2 * | 6/2013 | McGarian | E21B 7/061 166/55.6 |
| 10,724,322 | B2 * | 7/2020 | Taylor, Jr. | E21B 7/061 |
| 2002/0170713 | A1 * | 11/2002 | Haugen | E21B 27/00 166/117.6 |
| 2009/0266544 | A1 * | 10/2009 | Redlinger | E21B 7/068 166/298 |
| 2018/0347613 | A1 * | 12/2018 | Stokes | E21B 29/002 |

* cited by examiner

*Primary Examiner* — Tara Schimpf
*Assistant Examiner* — Lamia Quaim
(74) *Attorney, Agent, or Firm* — Baker Hughes Patent Organization

(57) ABSTRACT

A downhole system and a method of performing an operation downhole. The downhole system includes a string, a downhole tool, and a release device. A downhole tool is coupled to a string via the release device. The release device includes a shear member therein having a first shear axis that has a first shear resistance and a second shear axis having a second shear resistance less than the first shear resistance, wherein the first shear axis is aligned with a longitudinal axis of the string and the second shear axis is aligned with a circumferential axis of the string. The string is conveyed through a borehole to place the downhole tool at a selected location of the borehole. The downhole tool is secured within the borehole and the string is rotated to release the release device.

9 Claims, 5 Drawing Sheets

ANISOTROPIC MECHANICAL SHEAR BOLT

BACKGROUND

In the resource recovery industry, a main borehole can be drilled in a formation and one or more secondary boreholes can be drilled off of the main borehole. In order to start the secondary borehole, a drill string is lowered into the main borehole with a whipstock secured to its lower end. Once the whipstock is anchored in place in the main borehole, the drill string can be disengaged from the whipstock and moved downward. The anchored whipstock diverts the drill string into the wall of the main borehole, thereby cause the drill string to commence drilling of a secondary borehole. Currently, a shear mechanism is used to separate the whipstock from the drill string. The shear mechanism limits the magnitude of the forces that can be applied to the drill string while the whipstock is engaged to the drill string. This limit causes issues when increased forces are needed when the drill string encounters debris or bridges or gets stuck downhole. Accordingly, there is a need for a shear mechanism that does not limit the application of forces along the drill string prior to separating the whipstock from the drill string.

SUMMARY

Disclosed herein is a method of performing an operation downhole. The method includes coupling a downhole tool to a string via a release device, the release device including a shear member therein having a first shear axis that has a first shear resistance and a second shear axis having a second shear resistance less than the first shear resistance, wherein the first shear axis is aligned with a longitudinal axis of the string and the second shear axis is aligned with a circumferential axis of the string, conveying the string through a borehole to place the downhole tool at a selected location of the borehole, securing the downhole tool within the borehole, and rotating the string to release the release device.

Also disclosed herein is a downhole system including a string, a downhole tool, and a release device configured to couple the downhole tool to the string. The release device includes a shear member therein having a first shear axis that has a first shear resistance and a second shear axis having a second shear resistance less than the first shear resistance, wherein the first shear axis is aligned with a longitudinal axis of the string and the second shear axis is aligned with a circumferential axis of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
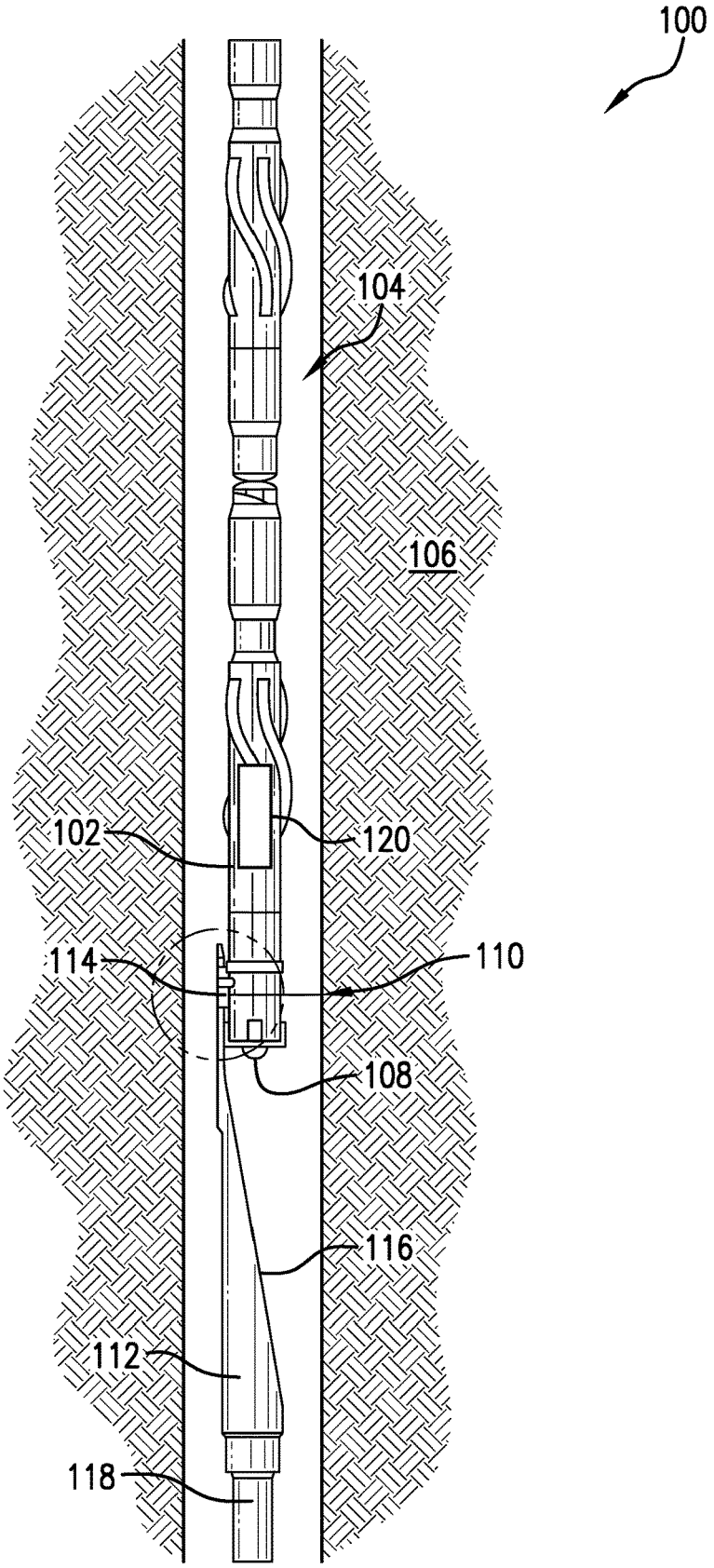
FIG. 1 shows a downhole system in an illustrative embodiment.

Referring to FIG. 1, a downhole system 100 is shown in an illustrative embodiment. The downhole system 100 includes a string 102 extending through a borehole 104 in a formation 106 from a surface location. In various embodiments, the string 102 can be a pipe string, a conveyance string, a pumping string, a snubbing string, a drill string, etc. The string 102 include a drill bit or milling device 108 at a bottom end 110. A downhole tool 112 is attached to the bottom end 110 of the string 102 above the milling device 108 via a release device 114 and is conveyed downhole with the string 102. In various embodiments, the downhole tool 112 can be a whipstock, a packer, a screen, a downhole pump, etc. The whipstock includes an angled surface 116 for diverting a path of the string 102. The string 102 can be conveyed into the borehole 104 to a desired location. Once the string 102 is at the desired location, the whipstock is secured to a wall of the borehole 104 via an anchor 118. Rotating the string 102 with the whipstock anchored in place causes the release device 114 to shear, thereby allowing the string 102 to separate from the whipstock. Once separated from the whipstock, the string 102 can be moved downward, allowing the whipstock to divert the path of the string 102 to form a secondary borehole.

The string 102 can include an additional device 120 for performing other downhole actions. For example, the additional device 120 can be one or more sensors for measuring a downhole parameter during conveyance of the string 102 through the borehole 104. In another embodiment, the additional device 120 can be a scraping tool for scraping and/or cleaning the borehole 104 during conveyance of the string 102 through the borehole 104. In another embodiment, the additional device 120 can be a pump for pumping or circulating fluid through the string 102. The pump can be disposed within the string or disposed at a surface location. The fluid can be pumped through the string 102 during conveyance of the string 102 to the desired location or once the downhole tool 112 has been secured at the desired location. Once the downhole tool 112 has been secured in borehole, tension. compression and/or a cycling between tension and compression can be applied along a longitudinal axis of the string 102.

Figure 2:
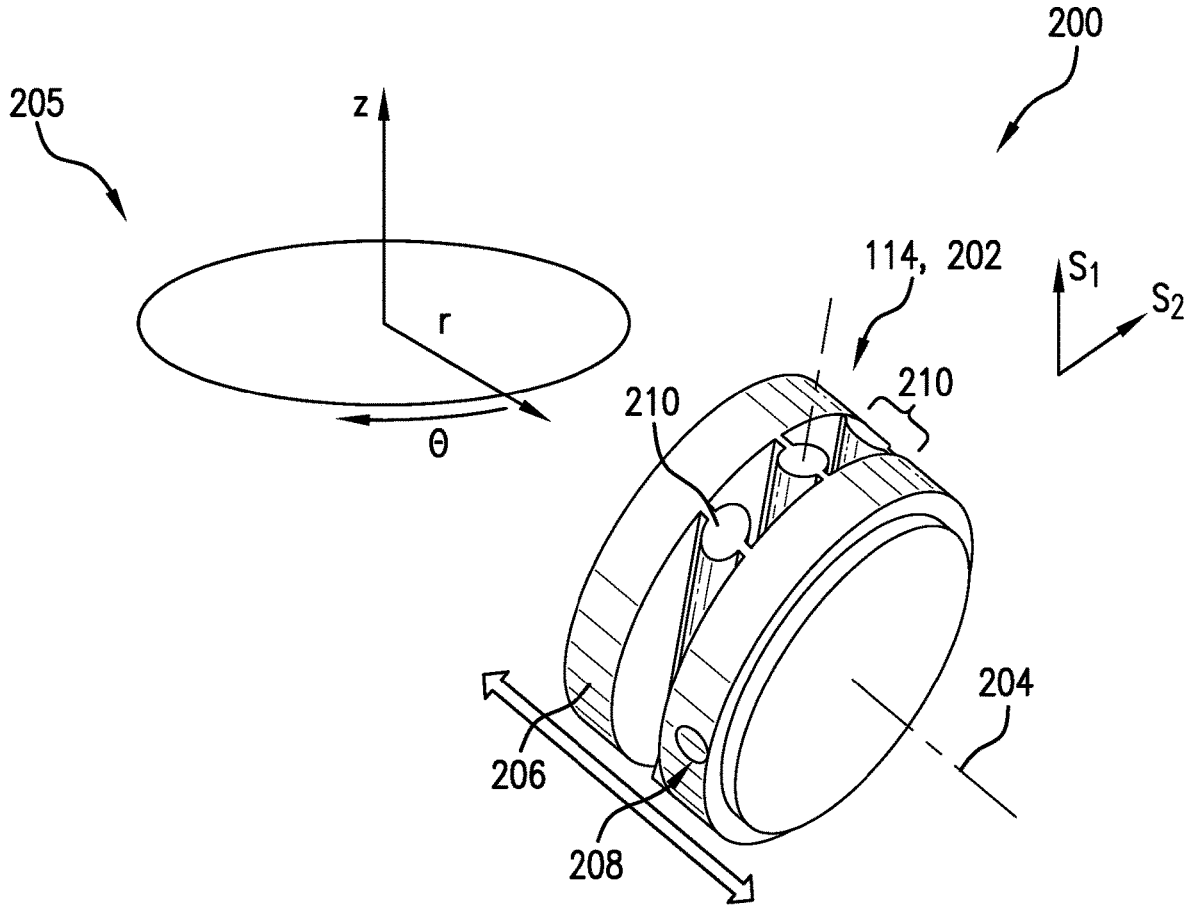
FIG. 2 shows a perspective view of a release device of the downhole system, in an illustrative embodiment.

FIG. 2 shows a perspective view 200 of the release device 114, in an illustrative embodiment. In the embodiment of FIG. 2, the release device is a bolt 202. The bolt 202 is shown with respect to a string coordinate system 205 to show a relative orientation of the bolt 202 with respect to the string 102. The string coordinate system 205 includes a longitudinal string axis (z-axis) oriented along a longitudinal axis of the string 102 and a radial axis (r-axis) extending radially away from the longitudinal axis. A circumferential axis (θ axis) shows a direction of rotation of the string 102.

When attaching the downhole tool 112 to the string 102, a longitudinal bolt axis 204 is aligned or substantially aligned with the radial axis of the string 102. The bolt 202 is in the general shape of a cylinder that includes a first shank 206 and a second shank 208 separated by a shear region 210. A transverse cross-section of the bolt 202 can be circular or can be in the shape of an oval or ellipse, with a major axis of the ellipse aligned with the longitudinal axis of the string 102.

The shear region 210 includes one or more anisotropic shear members 212. The anisotropic shear members 212 have a structure with a first shear axis $S_1$ having a first resistance to shear and a second shear axis $S_2$ having a second resistance to shear. The second resistance to shear is less than the first resistance to shear. When the bolt 202 is used to couple the downhole tool 112 to the string 102, the first shear axis $S_1$ is aligned with the longitudinal axis of the string 102 and the second shear axis $S_2$ is aligned with the θ axis of the string 102.

A shear member 212 can have a body that extends along a member axis that lies within a transverse plane of the bolt 202 (i.e., a plane transverse to the longitudinal bolt axis 204) and oriented along the first shear axis $S_1$. In an illustrative embodiment, the body of the shear member 212 can be in the form of a cylinder having its cylinder axis (i.e., longitudinal axis of the cylinder) lying within the transverse plane of the bolt 202. As referred to herein, a cross-section perpendicular to the cylinder axis can have any shape, such as circular, oval, square (a four-sided cylinder), hexagonal (a hexagonal cylinder), octagonal, etc.

Figure 3:
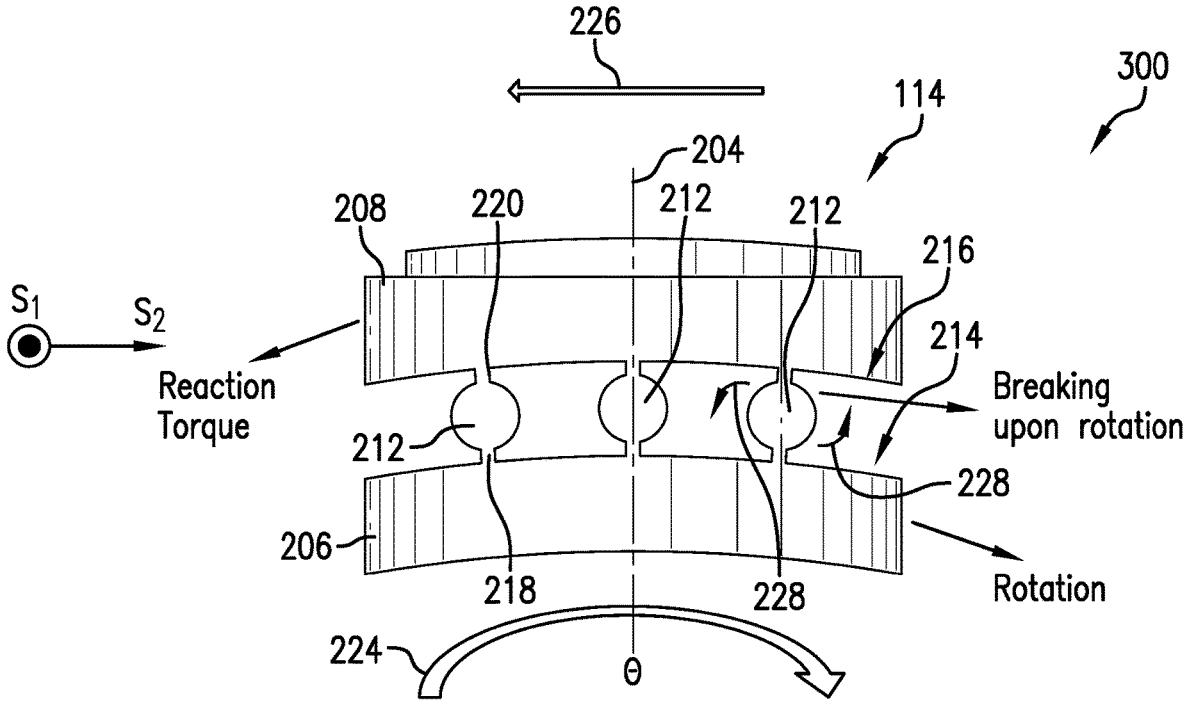
FIG. 3 shows a side view of a bolt from a location looking along a longitudinal axis of the string.

FIG. 3 shows a side view 300 of the bolt 202 from a location looking along a longitudinal axis of the string 102. The first shank 206 is the innermost shank and is coupled to the string 102. The second shank 208 is the outermost shank and is coupled to the downhole tool 112. For each shear member 212 a first location on a circumferential side of the cylinder connects to a first gap surface 214 of the first shank 206 and a second location on the circumferential side of the cylinder diametrically opposite the first location connects to a second gap surface 216 of the second shank 208. A first beam 218 extends between the first location of the circumferential side of the cylinder to the first gap surface 214 to mechanically connect the shear member 212 to the first shank 206. Similarly, a second beam 220 extends between the second location of the circumferential side of the cylinder and the second gap surface 216 to mechanically connect the shear member 212 to the second shank 208.

A rotation of the string 102 is shown by torque arrow 224. A reaction torque due to the downhole tool 112 being anchored in the borehole 104 is shown by reaction arrow 226. As these torques are applied, the shear member 212 rotates (as indicated by shear rotation arrows 228), thereby rupturing the first beam 218 and/or the second beam 220. Thus, the first shank 206 is separated from the second shank 208 via the rotation of the string 102, thereby releasing the downhole tool 112 from the string 102.

Forces applied along the longitudinal axis of the string (i.e., via movement of the string 102 through the borehole) do not cause this rotation but instead are applied along the first shear axis $S_1$ of the shear members 212. The shear resistance along the first shear axis $S_1$ allows highs forces to be applied in this direction.

Figure 4:
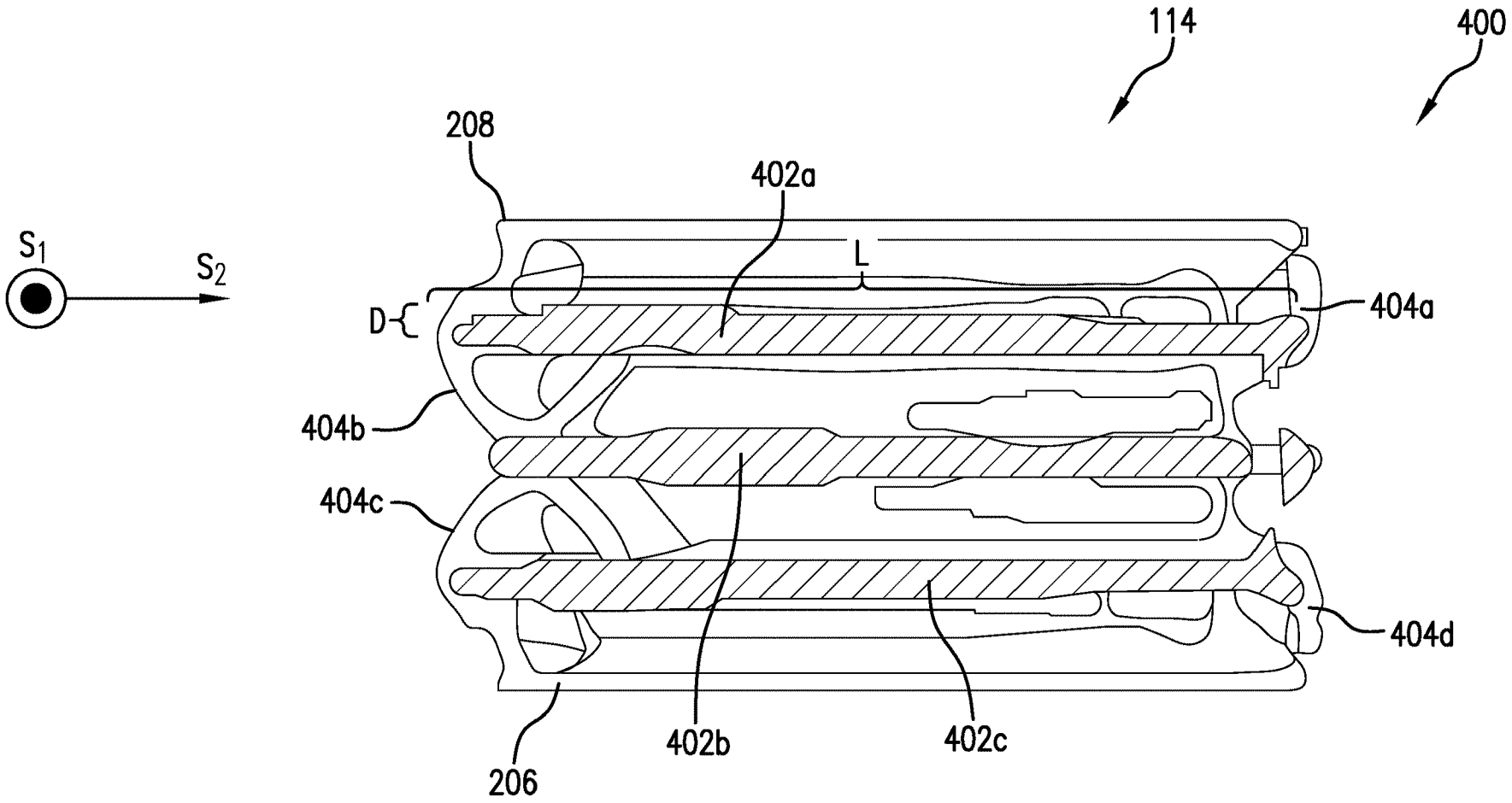
FIG. 4 shows a side view of the bolt as seen at a location along the longitudinal axis of the bolt, in another embodiment.

FIG. 4 shows a side view 400 of the bolt 202 as seen at a location along the longitudinal axis of the bolt 202, in another embodiment. The bolt 202 includes the first shank 206 and the second shank 208. Thin rectangular parallelepiped structures 402*a*, 402*b*, and 402*c* are disposed within the shear region substantially parallel to the gap surfaces of the first shank 206 and second shank 208. Although three rectangular parallelepiped structures 402*a*, 402*b*, and 402*c* are shown for illustrative purposes, in other embodiments, any plurality of rectangular parallelepiped structures can be within the shear region. A cross-section of the rectangular parallelepiped structures 402*a*, 402*b*, and 402*c* shows rectangles having a long axis L and a short axis D. A first rectangle can be joined to a second or adjacent rectangle by a connecting beam 404*a*, 404*b*, 404*c*, 404*d* at adjacent ends of their long axes. Rotating the string 102 ruptures one or more of the connecting beams 404*a*, 404*b*, 404*c* and 404*d*, thereby releasing the downhole tool 112 from the string 102.

Figure 5:
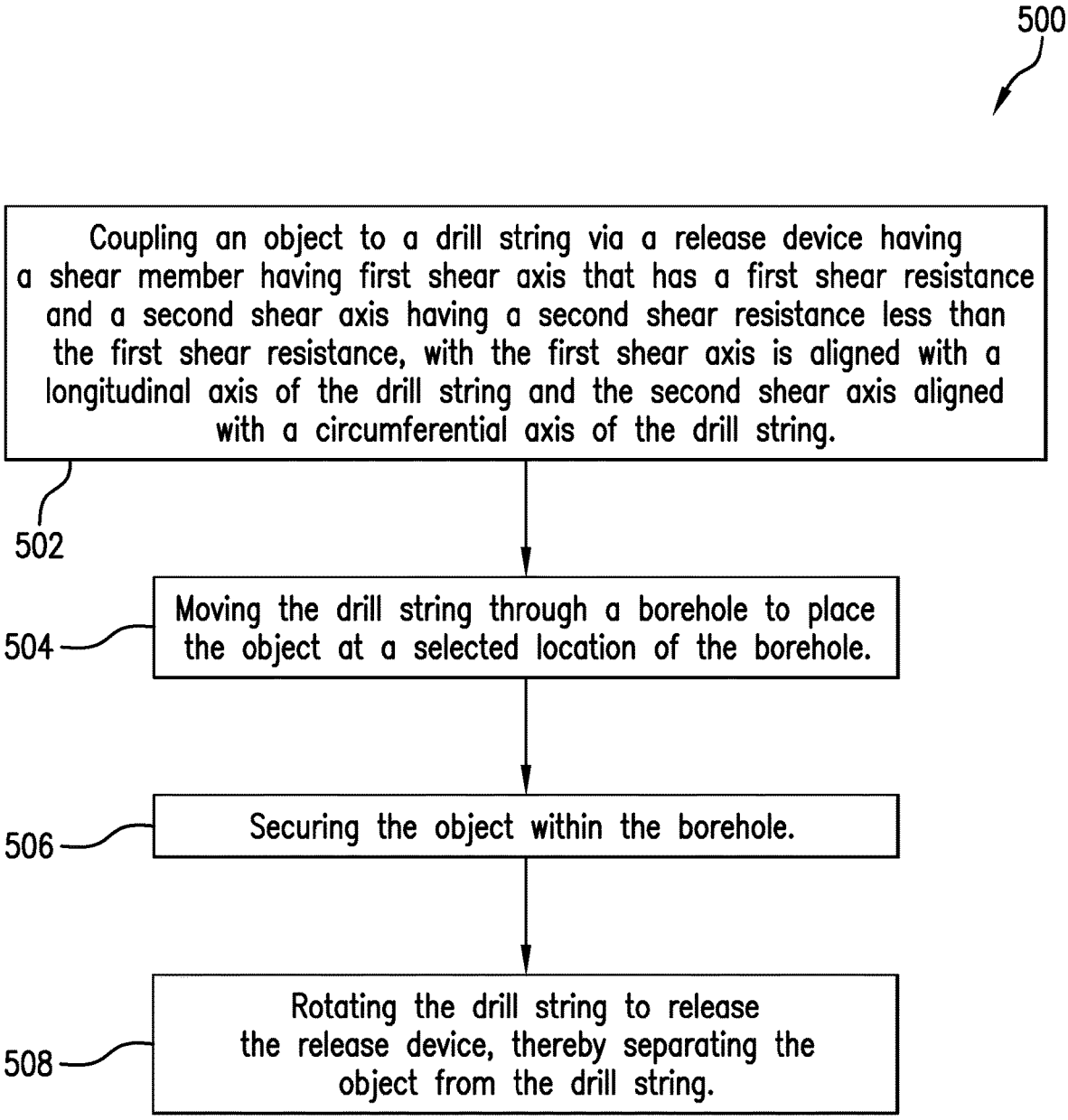
FIG. 5 shows a flowchart of a method for performing an operation downhole.

FIG. 5 shows a flowchart 500 of a method for performing an operation downhole. In box 502, a downhole tool is coupled to a string via a release device. The release device shear member has a first shear axis that has a first shear resistance and a second shear axis having a second shear resistance less than the first shear resistance. The first shear axis is aligned with a longitudinal axis of the string and the second shear axis is aligned with a circumferential axis of the string. In box 504, the string is moved through a borehole to place the downhole tool at a selected location of the borehole. In box 506, the downhole tool is secured within the borehole. In box 508, the string is rotated to create a force along the second shear axis that ruptures the shear member, thereby releasing the release device and separating the downhole tool from the string.

In various embodiments, the bolt can be made of a carbon fiber, steel, a Nickel alloy, bronze, or copper.

Set forth below are some embodiments of the foregoing disclosure:

Embodiment 1. A method of performing an operation downhole. A downhole tool is coupled to a string via a release device, the release device including a shear member therein having a first shear axis that has a first shear resistance and a second shear axis having a second shear resistance less than the first shear resistance, wherein the first shear axis is aligned with a longitudinal axis of the string and the second shear axis is aligned with a circumferential axis of the string. The string is conveyed through a borehole to place the downhole tool at a selected location of the borehole. The downhole tool is secured within the borehole. The string is rotated to release the release device.

Embodiment 2. The method of any prior embodiment, wherein the shear member further includes a bolt having a longitudinal bolt axis, the bolt includes a first shank and a second shank separated by a shear region, wherein the shear region includes the shear member therein.

Embodiment 3. The method of any prior embodiment, wherein the shear member includes a body having a member axis oriented within a transverse plane of the bolt and aligned with the longitudinal axis of the string.

Embodiment 4. The method of any prior embodiment, wherein the body is coupled to a first gap surface of the first shank at a first location along a circumferential side of the body and to a second gap surface of the second shank at a second location along the circumferential side of the body diametrically opposite the first location.

Embodiment 5. The method of any prior embodiment, further including a first beam at the first location extending along the member axis and a second beam at the second location extending along the member axis.

Embodiment 6. The method of any prior embodiment, further including rotating the string to separate the shear member from at least one of the first gap surface and the second gap surface.

Embodiment 7. The method of any prior embodiment, further including performing at least one of: (i) measuring a downhole parameter while conveying the string to the selected location; (ii) scraping the borehole while conveying the string to the selected location; (iii) cleaning the borehole while conveying the string to the selected location; (iv) pumping a fluid through the string; (v) applying a compression along the string with the downhole tool secured within the borehole; and (vi) applying a tension along the string with the downhole tool secured within the borehole.

Embodiment 8. A downhole system includes a string, a downhole tool, and a release device configured to couple the downhole tool to the string, the release device including a shear member therein having a first shear axis that has a first shear resistance and a second shear axis having a second shear resistance less than the first shear resistance, wherein the first shear axis is aligned with a longitudinal axis of the string and the second shear axis is aligned with a circumferential axis of the string.

Embodiment 9. The system of any prior embodiment, wherein the release device further includes a bolt having a longitudinal bolt axis, the bolt comprising a first shank and a second shank separated by a shear region, wherein the shear region includes the shear member therein.

Embodiment 10. The system of any prior embodiment, wherein the shear member includes a body having a member axis oriented within a transverse plane of the release device and aligned with the longitudinal axis of the string.

Embodiment 11. The system of any prior embodiment, wherein the body is coupled to a first gap surface of the first shank at a first location along a circumferential side of the body and to a second gap surface of the second shank at a second location along the circumferential side of the body diametrically opposite the first location.

Embodiment 12. The system of any prior embodiment, further including a first beam at the first location extending along the member axis and a second beam at the second location extending along the member axis.

Embodiment 13. The system of any prior embodiment, wherein the shear member is configured to separate from at least one of the first gap surface and the second gap surface upon a rotation of the string.

Embodiment 14. The system of any prior embodiment, wherein the shear member includes a plurality of rectangular parallelepiped structures parallel to a first gap surface of the first shank and a second gap surface of the second shank.

Embodiment 15. The system of any prior embodiment, wherein a transverse cross-section of the release device is in a shape of one of: (i) a circle; (ii) an ellipse; (iii) an oval; (iv) a square; (v) a hexagon; and (vi) an octagon.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of performing an operation downhole, comprising:

coupling a downhole tool to a string via a release device, the release device comprising a bolt having a longitudinal bolt axis aligned with a radial axis of the downhole tool, the bolt comprising a first shank and a second shank separated along the longitudinal bolt axis by a shear region including the shear member therein, the shear member including a cylindrical body having a member axis oriented within a transverse plane of the bolt and aligned with the longitudinal axis of the string, the cylindrical body coupled to a first gap surface of the first shank at a first location along a circumferential side of the cylindrical body and to a second gap surface of the second shank at a second location along the circumferential side of the cylindrical body diametrically opposite the first location, wherein the shear member has a first shear axis that has a first shear resistance and a second shear axis having a second shear resistance less than the first shear resistance, wherein the first shear axis is aligned with a longitudinal axis of the string and the second shear axis is aligned with a circumferential axis of the string;

conveying the string through a borehole to place the downhole tool at a selected location of the borehole;

securing the downhole tool within the borehole; and rotating the string to release the release device.

2. The method of claim 1, further comprising a first beam at the first location extending along the member axis and a second beam at the second location extending along the member axis.

3. The method of claim 1, further comprising rotating the string to separate the shear member from at least one of the first gap surface and the second gap surface.

4. The method of claim 1, further comprising performing at least one of: (i) measuring a downhole parameter while conveying the string to the selected location; (ii) scraping the borehole while conveying the string to the selected location; (iii) cleaning the borehole while conveying the string to the selected location; (iv) pumping a fluid through the string; (v) applying a compression along the string with the downhole tool secured within the borehole; and (vi) applying a tension along the string with the downhole tool secured within the borehole.

5. A downhole system, comprising:

a string;

a downhole tool; and a release device configured to couple the downhole tool to the string, the release device comprising a bolt having a longitudinal bolt axis, the bolt comprising a first shank and a second shank separated along the longitudinal bolt axis by a shear region including a shear member therein, the shear member including a cylindrical body having a member axis oriented within a transverse plane of the release device and aligned with the longitudinal axis of the string, wherein the cylindrical body is coupled to a first gap surface of the first shank at a first location along a circumferential side of the cylindrical body and to a second gap surface of the second shank at a second location along the circumferential side of the cylindrical body diametrically opposite the first location, the shear member having a first shear axis that has a first shear resistance and a second shear axis having a second shear resistance less than the first shear resistance, wherein the first shear axis is aligned with a longitudinal axis of the string and the second shear axis is aligned with a circumferential axis of the string.

6. The downhole system of claim 5, further comprising a first beam at the first location extending along the member axis and a second beam at the second location extending along the member axis.

7. The downhole system of claim 6, wherein the shear member is configured to separate from at least one of the first gap surface and the second gap surface upon a rotation of the string.

8. The downhole system of claim 5, wherein the shear member includes a plurality of rectangular parallelepiped structures parallel to a first gap surface of the first shank and a second gap surface of the second shank.

9. The downhole system of claim 5, wherein a transverse cross-section of the release device is in a shape of one of: (i) a circle; (ii) an ellipse; (iii) an oval; (iv) a square; (v) a hexagon; and (vi) an octagon.

* * * * *